United States Patent [19]

Chapman

[11] 4,016,585

[45] Apr. 5, 1977

[54] CENTER FILLING VARIABLE VOLUME FILM DRUM

[75] Inventor: Robert E. Chapman, Ann Arbor, Mich.

[73] Assignee: Photo Systems, Inc., Dexter, Mich.

[22] Filed: Aug. 14, 1975

[21] Appl. No.: 604,690

[52] U.S. Cl. ..... 354/331; 92/172; 354/341

[51] Int. Cl.[2] ..... G03D 13/02

[58] Field of Search ..... 354/328–331, 354/335, 340, 341; 92/250, 172; 220/93, 233, 234, 238

[56] References Cited

UNITED STATES PATENTS

| | | | |
|---|---|---|---|
| 2,125,285 | 8/1938 | Draeger | 354/341 X |
| 2,298,963 | 10/1942 | Naylor et al. | 354/341 X |
| 2,828,886 | 4/1958 | Thomas | 220/93 |
| 2,947,236 | 8/1960 | Siegel | 354/330 |
| 3,726,201 | 4/1973 | Berchtold | 354/340 X |
| 3,784,051 | 1/1974 | Shaw | 220/93 |

*Primary Examiner*—Richard L. Moses
*Attorney, Agent, or Firm*—Neuman, Williams, Anderson & Olson

[57] ABSTRACT

The present invention is directed to a variable volume film drum with a proportionally variable length conduit path for directing and controlling the flow of fluids introduced into the drum. The center conduit path is comprised of interconnecting conduit reels also used to hold the film. Each conduit reel has an internal conduit path, one end of which forms an outwardly extending flange or male portion and the distal end forms a receiving or female portion. As the volume of the container is varied to accommodate more or less reels, the conduit path formed by the interconnected reels is proportionally altered. The conduit reels are further connected to a fluid inlet tube in the film drum to complete an integral path for the introduction of fluids into the drum.

9 Claims, 4 Drawing Figures

CENTER FILLING VARIABLE VOLUME FILM DRUM

PRIOR ART

There are numerous apparatus for developing photographic film in the prior art including developing trays and tanks. The prior art tanks such as the Johnsons of Hendon Universal Developing Tank have a static, fixed or invariable volume tank. In these tanks, the film to be developed is placed on an appropriate size reel and inserted into the tank. A jar top type assembly seals the only opening of the tank. The jar top type assembly has a removable cap providing a single opening into which fluids may be poured during the developing process. One limitation of these prior art tanks was that the volume was fixed. Therefore, if a two reel tank was used to develop a single reel, there would be a waste in chemicals, by an amount necessary to fill the unused volume of the two reel tank. Also, if two reels were to be developed and the photographer had only a single reel tank then the process must be repeated twice, e.g., one reel developed at a time. This limitation required the photographer to keep in stock a plurality of different size developing tanks or waste chemicals by using a single large size and dummy reels (reels without film) to fill the container. Even the repetitious use of the single reel tank for developing two or more reels results in a certain waste of chemicals when compared to a single multi-reel developing operation since in every operation a certain amount of chemicals are needed to fill unused portions in the tank structure (e.g., grooves, gaskets, etc.).

The Unicolor Film Drum disclosed in U.S. Pat. Application Ser. No. 487,541 solved these and other problems by providing a variable volume film processing container. Succinctly, the Unicolor drum comprised an insulated film container, a lockable piston for insertion into the container to alter the volume and a fluid control assembly covering the opposite end of the container through which the processing chemistry is poured. The number of standard processing reels necessary to hold the film to be developed is selected and the drum sized by altering the position of the piston. The film to be developed is then placed on standard reels and inserted into the drum via the opened control assembly end. The assembly is now secured and the appropriate chemistry poured into the drum. The drum is agitated to force the chemistry into contact with the film, preferably by placing the drum on the Uniroller. However, when the chemistry is initially poured through the control assembly into the container, it cascades downward randomly contacting the film. In the new high temperature film process such as the Kodak C41 process, E6 process and unicolor K2 process the premature and uneven application of the chemistry due to this cascade action results in stains on the film.

The use of fixed center filling tubes for standard fixed volume paper processors in known as illustrated by U.S. Pat. No. 3,705,544 issued to Simon Ratowsky on Dec. 12, 1972. In such processors a large tube is mounted down the center of the tank and the sheet paper is placed substantially around the internal periphery of the tank. The chemistry is poured down the tube and collects or pools in the bottom of the container. The container is then tipped to a horizontal position and agitated to cause the chemistry to contact the paper. However, such center filling techniques were unavailable for reel film development due to the incompatibility of the reel structure and center tube element of the tank. Furthermore, the use of a center tube for filling a variable volume cylinder which would require a variable length center tube was unknown.

SUMMARY OF THE INVENTION

The present invention is an improvement of the apparatus for processing materials by the application of fluids disclosed in U.S. Pat. Application Ser. No. 487,541 filed July 11, 1974 entitled Apparatus and Method for Processing Photographic Materials and incorporated herein by reference. The instant invention relates to a variable volume-container for the processing of material by fluids introduced into the container through a center conduit means to avoid premature random fluid contact with the material. The center conduit means varies in length proportionally to the volume of the container. The conduit means is formed by at least one and usually a plurality of specially structured film reels. An individual conduit reel is similar in general overall structural form to the commercially available standard. However, at one end of the axial or middle tubular portion an outwardly extending tubular flange is formed to function as a connecting male segment and the opposite end of the middle portion is formed to function as a receiving or female element for the male portions of adjacent conduit reels. Thus, the male portion of one reel interconnects with the female portion of an adjoining reel to form a variable length center conduit. A fluid control assembly detachably secured to one end of the container portion of the variable volume film drum has a tube portion extending into the container to provide the only fluid inlet. This tube portion of the assembly interconnects with the conduit reel adjacent the assembly to complete a fluid path or conduit extending from the fluid control assembly through the conduit reel adjacent the piston. The piston which is movable within the container to alter the internal volume until it is compatible with the quantity of film reels placed within the container and then is lockable to form a fluid-tight seal is provided with a plurality of spacer means which contact the adjacent conduit reel to offset it from the flat surface of the piston. The spacers provide a free flow path for fluids exiting from the adjacent conduit reel. Thus, fluids introduced into the container via the control assembly flow only through the center conduit path formed by the interconnection of conduit reels and the assembly tube segment.

The fluids exiting the conduit path at the bottom conduit reel adjacent the piston begin to fill the container in a controlled uniform manner. The random cascading and splashing of the chemistry within the container which caused spotting and streaking of the film is eliminated. Since the volume of the film container is varied depending on the number of reels of film to be processed and each conduit reel forms a segment of the total center conduit path, the length of the path varies proportionally to the volume of the container. The uppermost conduit reel interconnects with the extending tubular segment of the control assembly and the bottommost conduit reel abuts the spacer means of the piston thereby providing functional cooperation between the interconnected conduit reels and the elements of the film drum.

An object of the present invention is to provide a variable volume container for processing a material by the application of fluids into the container through a variable length center conduit means.

Another object of the present invention is to provide a reel structure including a center conduit adapted to be interconnected with other reels.

Another object of the present invention is to provide variable volume film drums for use with high temperature chemistry applied through a proportionally variable length center conduit means.

Another object of the present invention is to provide a variable volume film drum for processing photographic material by the application of fluids applied through a proportionally variable length center conduit means formed by the interconnection of individual conduit reels.

BRIEF DESCRIPTION OF THE DRAWINGS

Further and additional objects will appear from the following detailed description of a specific embodiment read in conjunction with the accompanying drawings, wherein.

Figure 3:
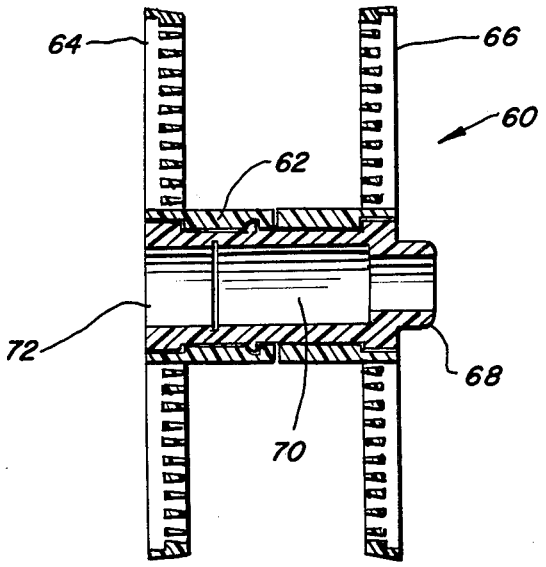

FIG, 2 is an illustration of the fluid-flow control cover assembly;

FIG. 3 is a cross section of the conduit reel structure; and

Figure 2:
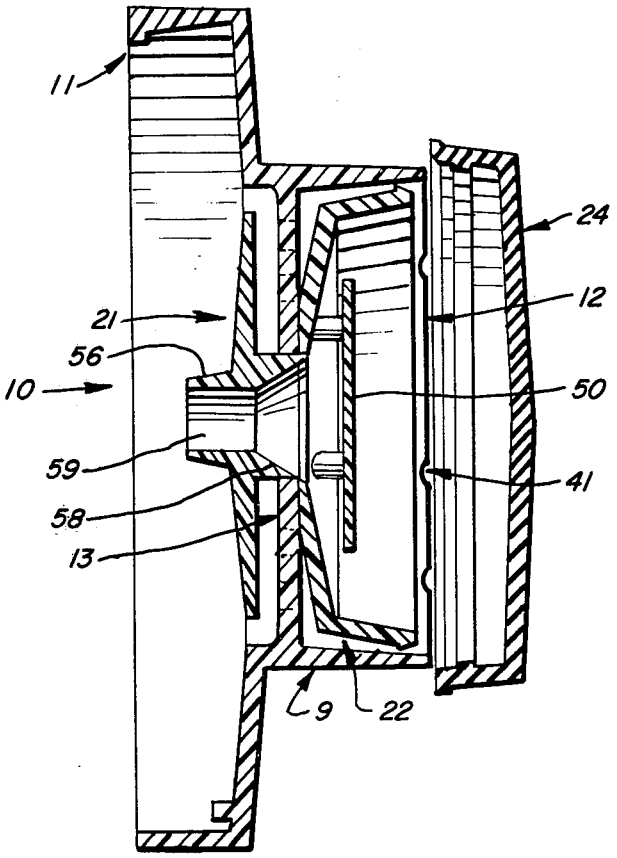
Figure 4:
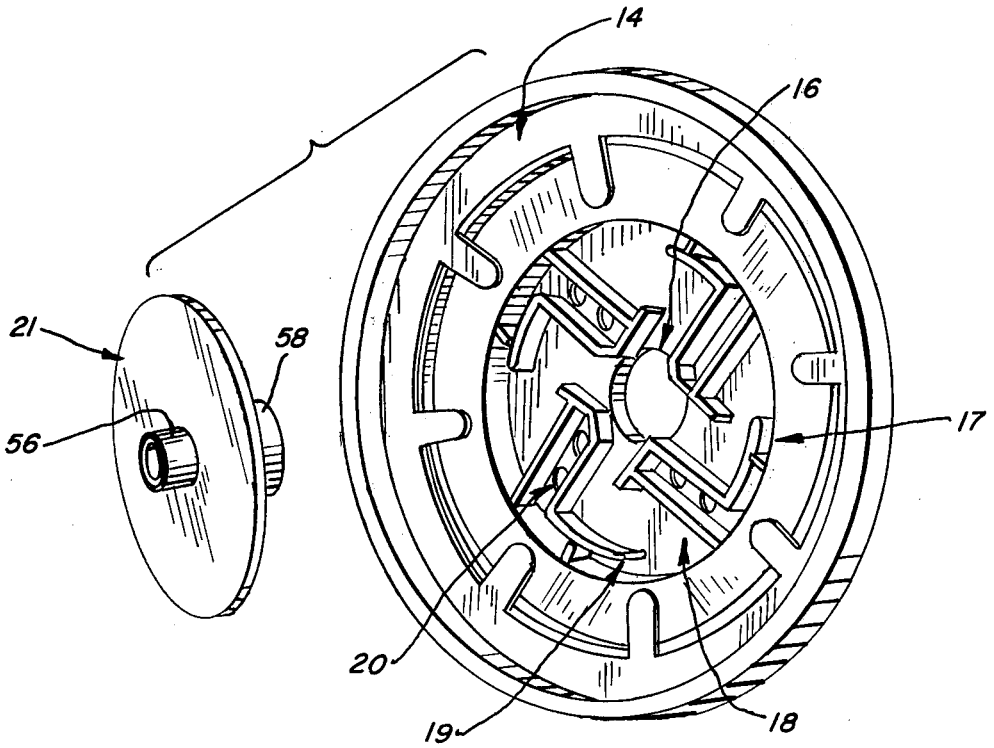

FIG. 4 is an oblique view showing the interior structure of the cover assembly of FIG. 2.

DETAILED DESCRIPTION OF DRAWINGS

Figure 1:
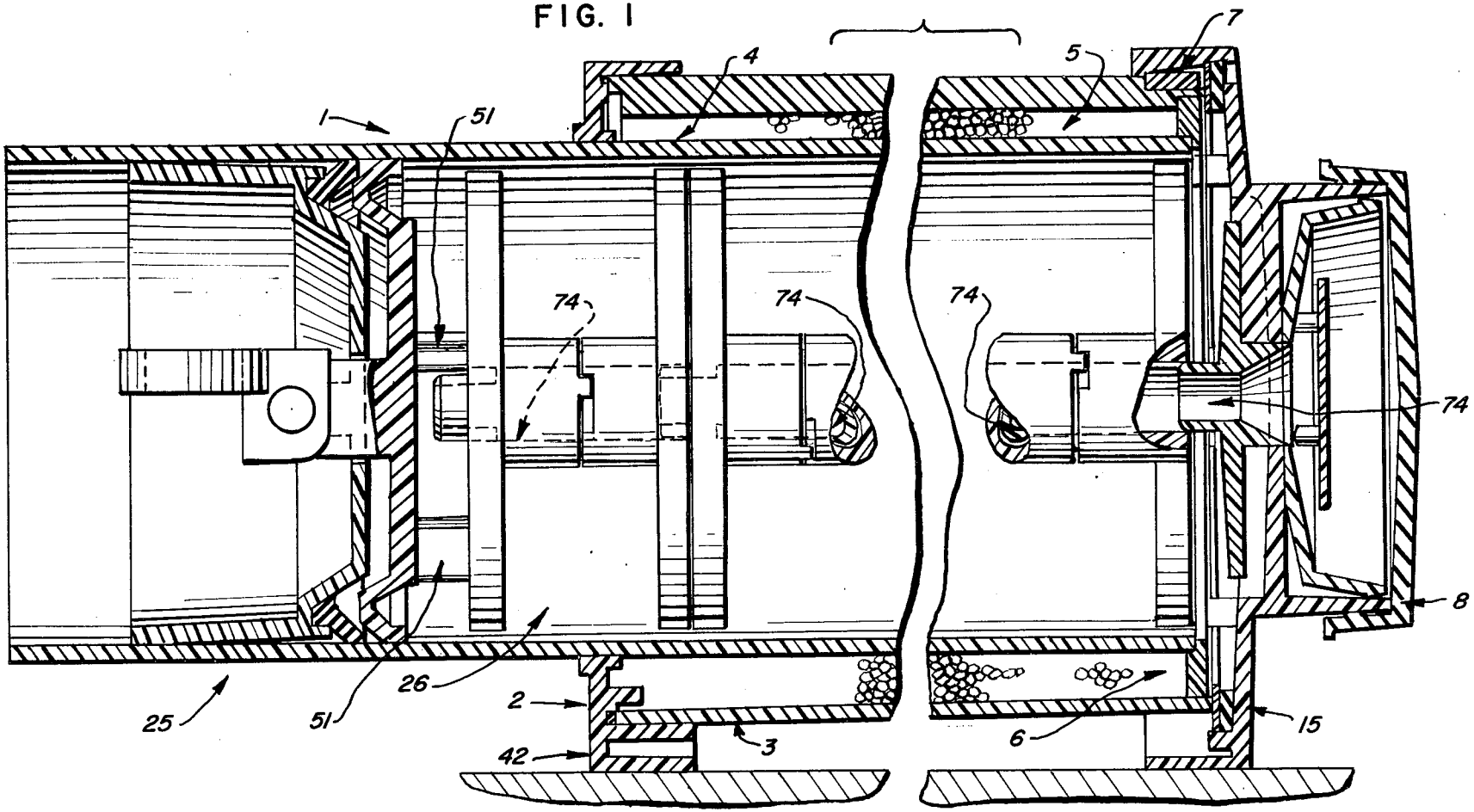
FIG. 1 is the preferred embodiment of the present invention.

The film drum with a plurality of conduit reels 60 inserted generally indicated in FIG. 1, includes a film deposit container 1 which is a substantially cylindrical and hollow tube-like member made from plastic or the like. The cylindrical container is referred to throughout the disclosure but it is to be understood that other geometrical shapes which have the same attributes needed herein could be used. At a point about ¾ of the cylinder's longitudinal length, an external annular support member 2 is mounted. The support has a general cross sectional shape which is the same as the cross sectional shape of the container 1 and is affixed to the container 1 by cementing or any other similar process which forms an air-tight seal. An insulatng container 3, with the same geometric shape as the film container 1 but a greater diameter and shorter longitudinal length, is placed concentrically over the film container 1 until one end abuts the support member 2. The opposite end of the insulating container 3 extends to a point in space substantially even with one end of the film container 1. The abutting end of the insulating container 3 is sealed to the support member 2 by cementing or any other similar process by which an air-tight seal can be formed. Since the insulating container is of a greater diameter than the film container, a chamber 4 is defined therebetween. The support 2 forms the bottom of the chamber 4 while the film container 1 and the insulating container 3 form its walls. A measured quantity of Vermiculite 5 is poured into and substantially fills the chamber 4. Vermiculite is a standard insulating material and any other similar material could be used in its place provided that it has low thermal conductivity and some thermal inertia or heat holding capability. A ring member 6 is secured over the annular opening of chamber 4. The ring 6 is cemented or the like between the edge of the film container 1 in the edge of the insulating container 3 forming an air-tight seal. The Vermiculite 5 is now sealed in chamber 4 which is substantially air-tight.

As an alternative embodiment, the container structure comprising the film container 1, insulating container 3, support member 2, and ring member 6 could be formed of a polyurethane or ABS foam. If this or a similar material is used, the purpose of the Vermiculite is eliminated since the material itself has adequate thermal properties. Therefore, the necessity of forming the dual concentric cylinders defining a chamber to be filled with insulating material is eliminated. Hence, a single unitary structure in the shape of a substantially cylindrical and hollow tubelike member made of insulating material such as polyurethane is an alternative to the preferred embodiment described above.

As a further alternative embodiment to the container structure of FIG. 1, the insulating container 3 could be substantially the same longitudinal length as the film container 1. The ends of the containers would be sealed together to form a chamber for the Vermiculite or other insulating material. The Vermiculite chamber could, therefore, extend over the entire length of the film container or to any point less than the entire length of the container.

A foot or extension 42 is mounted on the insulating container 3. The foot 42 acts as a stop during manual horizontal agitation of the durm during the developing process. The foot 42 can be attached by cementing or the like or made integral with the insulating container 3 or any other element of the container structure. A plurality of locking tabs 7 are mounted in a space relationship circumferentially around the walls of the insulating container 3 close to the point where the ring member 6 is secured to the edge of the insulating container 3. A cover assembly 8 fits over the outer walls of the insulating container 3 and when rotated mates or locks with the tabs 7 sealing the cover assembly over the opening defined by the combined structure formed of the insulating container 3, the ring member 6 and the film container 1.

The fluid-flow control cover assembly 8 is illustrated in FIG. 2. A cover 9 forms the outer structure of the assembly. The cover 9 has a large diameter opening or mouth 10 which is sufficiently large to fit over the insulating container 3. This end of the cover 9 is provided with a plurality of extensions or locking ears 11 which mate with the tabs 7 when the cover assembly is rotated. The opposite end of the cover 9 has an opening 12, the diameter of which is smaller than the opening 10. At a point between the mouth 10 and the opening 12, the cover 9 forms a planar platform or shoulder 13 perpendicular to the longitudinal axis of the containers 1 and 3 when the extensions or locking ears 11 of the cover 9 are mated with a plurality of tabs 7.

The planar platform or shoulder 13 is best illustrated in FIG. 4 which is an oblique view showing the interior structure of the cover assembly 8. In FIG. 4, the circumferential edge of opening 10 is visible. A gasket 14 fits within the circumferential edge of the shoulder 13 of cover 9 and over the sealing gasket 15 shown in FIG. 1. The gasket 14 will contact the ring 6 when the cover assembly 8 is placed over the container structure. A substantially planar platform or shoulder 13 defines an aperture 16 at its center point. The platform 13 has a substantially circular recess 17 concentric with the aperture 16 but of a greater diameter. In the recess 17 of platform 13, a plurality of fluid exit control vanes 18 are mounted. The vanes 18 extend from the perimeter of aperture 16 in a convoluted pattern towards the circumferential edge of the recess 17.

The vanes 18 are formed by thin side wall members 19 which are of a height slightly shorter than the depth of recess 17. Within the recess 17 of the shoulder 13 and positioned within the side wall member 19 which define each of the vanes 18 is at least one air aperture 20 extending through the shoulder 13. The air apertures 20 function to equalize the pressure between the interior of the film container 1 and the atmosphere so that fluid flows easily into or out of the container 1.

Over the vanes 18 is mounted a flow directing plate 21 which is of the same generally circular shape as the recess 17 but is slightly smaller in diameter. The plate 21 has an outwardly extending annular flange 56 forming an opening on the side of the plate facing into the container when the cover assembly is in place. Integrally connected with the flange 56 is a funneled tubular element 58 which extends through the recess 17 and connects with the aperture 16. The combination of the flange 56 and plate 21 and funnel element 58 provides a conduit 59 for fluid entry directly into the container. However, it should be noted that while fluid can flow into the container only as described above, the fluid can exit the container through both the conduit 59 and by passing through recess 17 in the platform 13 and through apertures 20. It is apparent at this point that while vanes 18 are used in the preferred embodiment, the pattern of the vanes and the vanes themselves are not critical or necessary to the present invention, however, the vanes do promote smooth exit of fluid from the container.

A second funnel element 22 is attached by cementing or the like to the side of the planar platform 13 opposite the vanes 18 and surrounding aperture 16. The funnel 22 provides a smooth passage for fluid between the opening 12 and the aperture 16 in the platform 13. Therefore, the fluid place in the funnel 22 will flow only out of the flange 56 into the container. The funnel 22 completes the air path from the interior of film container 1 to the atmosphere by forming a channel 23 between the aperture 20 and the atmosphere, refer to FIG. 2. Mounted over the aperture 16 and onto the surface of the funnel 22 is the disc shaped element 50. The disc 50 is spaced over the aperture 16 to allow free fluid flow, however, the disc 50 acts as a light trap to eliminate ambient light from entering the interior of container. The above portion of the cover assembly 8 is made of component parts adhered together by cementing or the like; however, one or more of the parts may be integrally formed. This portion of the cover assembly is fitted over the container structure and sealed in a fluid-tight relationship by rotating the cover assembly 8 which mates extensions 11 with the plurality of tabs 7.

Over the cover 9 there is placed a removable cap 24 part of the assembly 8. The cap 24 forms a fluid-tight pressed seal over the opening 12 and the channel 23. Other forms of removable fluid-tight seals could also be used. The cap is removed to allow fluid to flow into or out of the container 1. Thus, the fluid-flow control cover assembly 8 has two separate and selectable positions. The first position corresponds to having the cap 24 over the cover 9 forming an impermeable seal. The second position corresponds to having the cap 24 removed for permitting fluid flow into or out of the film container.

As an alternative embodiment, a cap 24 could be provided with a small air hole at its center point to vent gases produced by the chemistry. Furthermore, since the drum is usually only one-half filled, the air hole does not eliminate the functional fluid-tight purpose of cap 24.

At the opposite end of the film container 1 in FIG. 1, a plug assembly is inserted. The plug assembly 25 is movable within the film container 1 along the container's longitudinal axis. As the plug assembly 25 is moved toward the cover assembly 8, the volume 26 within the container 1 is reduced. The container volume 26 is defined by the plug assembly 25, the cover assembly 8 and the interior walls of the film container 1. Conversely, as the plug assembly 25 is moved away from the cover assembly 8, the volume defined above increases rather than decreases. Therefore, it is clear that by the movement of the plug assembly 25, the internal volume 26 of the container 1 can be varied.

The plug assembly 25 is the same as disclosed in copending U.S. Application Ser. No. 487,541 except for the addition of a plurality of spacing means 51. The plug or piston assembly illustrated in FIG. 1 is in the unlocked or movable position. To lock the plug, forming a fluid-tight seal, the ring portion is pivoted downward causing a base plate to force a sealing gasket to expand. A detailed description of the plug assembly is contained in the above identified application and further description is unnecessary herein since the type and operation of the plug assembly is not an essential feature of the present invention. Any piston or plug which is movable within a container to vary the container's internal volume and is capable of forming a fluid-tight seal in a selected position and has the above described spacing means can be used.

An individual reel of the present invention is illustrated in cross section in FIG. 3. The general overall structure of the film reel 60 is similar to standard commercially available film reels such as Unicolor No. 322. Therefore, the procedure for loading the reel with film and the details of structure are not set forth herein. The reel 60 is generally formed by a central or middle tubular portion 62 and two annular disc shaped portions 64 and 66. The disc shaped portions 64 and 66 have apertures at their center in which the middle portion 62 is fitted. The disc portions are thereby attached to the ends of the middle portions normal to its longitudinal axis. The reel is adapted to receive photographic film to be processed. At one end of the middle portion 62, an outwardly extending tubular flange 68 is formed. The tubular flange 68 extends beyond the plane of disc 66 and together with the middle portion 62 forms a conduit 70. The distal portion of the conduit 70 terminates substantially flush with the plane of disc 64 and forms an aperture 72. The aperture 72 has a diameter slightly larger than the outside diameter of the tubular flange 68. The tubular flange 68 forms a male connecting segment and the distal portion of the conduit 70 forming aperture 72 is a female connecting segment. The length of the conduit path can be varied depending on the number of conduit reels that are connected. Since the volume of the container is varied based on the number of reels to be inserted, as more fully described hereinafter in the Operation section, the length of the conduit path varies proportionally. Thus, when fluid is introduced into the container 1, it will be confined to the conduit path 74 until exiting in a uniform flow at the bottom or plug end of the container and the cascading or splashing of the fluid over the film is avoided.

As best illustrated in FIG. 1, a tubular flange portion of one conduit reel will engage with the female portion of another adjacent conduit reel. If two or more conduit reels are juxtapositioned in this manner, the conduit 70 of each interconnects with the adjacent conduit to form an extended conduit path 74 adapted to transmit fluid. The conduit path means 74 thus formed extends down the center or longitudinal axis of the container. An alternative embodiment of the present invention would be to use hollow tubes of various lengths and insert a selected tube through the center of standard film reels to provide the conduit path for fluid flow. The tube selected would be dependent upon the number of reels inserted into the drum. The tubes of various lengths enable the developer to utilize standard film reels and still obtain the benefits of the variable volume center fill film drum.

OPERATION

The suggested or preferred method of using the film drum for developing photographic film is described. It should be understood that the values used herein are merely illustrative and in addition the use of the film drum is not limited to photographic film, but rather includes the processing of any material by the application of fluids.

The initial step is to properly size the internal volume of the film container 1. To accomplish this, the plug assembly 25 is unsealed by pivoting the ring member to the vertical position permitting the assembly 25 to move with only a little friction within the film container 1. The entire film drum is placed in a vertical or upright position with the plug assembly end resting on a flat horizontal surface. The cover assembly 8 is unsealed and removed by rotating the assembly unmating the extensions 11 and the tabs 7. At this point, it is important to visually inspect the film drum and the reels to insure that they are dry and free of chemicals which could contaminate the developing process. Without loading the film onto the reels, the number of reels to be used are placed inside the film container 1. The first reel is inserted so that its flange portion 68 extends towards the plug assembly 25. The first conduit reel placed witin the container 1 will rest upon the spacer means 51 of the plug assembly so that the flange 68 is displaced a distance above the surface of the plug assembly. All subsequent conduit reels are also inserted within the container so that the flange portion is extending toward the previously inserted reel. The flange or male portion of each subsequent conduit reel will then engage with the distal or female portion of the previously inserted adjacent conduit reel. The cover assembly 8 is now replaced and sealed. The entire film drum 10 is tilted slightly from its vertical rest position enabling the user to reach the plug assembly 25. The plug assembly 25 is moved within the interior of the film container 1 toward the sealed cover assembly 8. The plug assembly 25 is moved in such a manner until the last inserted conduit reel contacts the cover assembly 8 and the spacer means contacts the bottom of the first inserted conduit reel. The plug assembly 25 is now sealed by pivoting the ring member to its horizontal position. The last inserted conduit reel will be flush with the end portion of the container 1 and the inwardly extending tubular flange portion 56 of the plate 21 of the cover assembly 8 will engage the distal or female portion 72 of this conduit reel. The conduit 70 of each conduit reel together with the flange 56 of the cover assembly forms a segment of a center tubular conduit. The interior volume of the film container 1 is now sized to the minimum volume required for the number of reels to be used. The suggested maximum capacity for the film drum is 4 120 size reels or 6 35 mm. size reels or any appropriate combination thereof. The cover assembly 8 is now removed and the conduit reel(s) taken out of the film container 1. In the darkroom, the film is loaded onto the conduit reels in the usual manner. The loaded conduit reels are placed into the film container 1 in the identical manner as described above and the cover assembly 8 is replaced and sealed. The user can now begin the process of daylight developing the loaded film since the film drum is both fluid and light-tight.

The appropriate chemistry is poured into the funnel element of 22 of the cover assembly 8. The fluid will pass through the aperture 16 and into the funneled tubular element 58 of plate 21. The fluid exits through the tubular flange 56 directly into the female portion 72 of the last inserted conduit reel 60. The chemistry thus introduced into the container 1 flows through each tubular conduit 70 of each interconnected conduit reel until it exits via the flange 68 of the first inserted conduit reel which is displaced a distance above the surface of the plug 25 by spacer means 51. It should be apparent that since the fluid is flowing downwardly and the male portion 68 of each reel (except the first inserted) and the tube 56 of the cover assembly 8 are connected to a slightly larger diameter female portion 72 of adjacent conduit reels the fluid will not leak at the junction points and the container 1 will fill in a uniform and controlled manner from the bottom or plug end. It should be noted, however, that the conduit reels could be inserted female portion first provided that the plate 21 of the cover assembly 8 was appropriately altered to provide a receptacle for the male portion of the last inserted conduit reel. This reversed assembly is not as desirable as the preferred embodiment since fluid leakage between male and female portions of adjacent conduit reels is present due to the fact that each female portion 72 is of a slightly larger diameter than the male portion 68. This difficulty can be corrected by providing closer tolerance connections or the use of a sealing type washer at each connection.

Suggested solution quantities are listed below in Table 1. These quantities are volumes required per reel for each film size. It is only required that the film container 1 be half-full when the agitating is done by manually rolling the film drum on a horizontal surface or by using the UNICOLOR Uniroller.

TABLE I

| FILM SIZE | SOLUTION VOLUME FIRST REEL | EACH ADDITIONAL REEL |
|---|---|---|
| –35 | 180 mL (6 oz.) | 60 mL (2 oz.) |
| 120 | 210 mL (7 oz.) | 150 mL (5 oz.) |

NOTE: A standard center loading reel requires approximately one (1) oz. (30 mL) more solution per reel than indicated in the above side loading reel Table.

To pour developing chemicals into or draining chemicals out of the film container, remove the cap 24. It is possible to tilt the drum at an angle and rest it upon any type of support structure to make pouring easier. The cap 24 must be repositioned over the container structure before the drum is again agitated. Since the film drum is essentially air-tight, back pressure which resists the positioning of the cap 24 may be experienced. In this case, lift the edge of the cap 24 while positioning it over the container structure to vent trapped air. In the preferred embodiment air pressure is vented through a small hole at the exact center of the cap 24. Gases generated by chemical reactions are similarly vented.

Some processes require careful temperature regulation and for these, the film drum is presoaked. In the preferred embodiment, the double cylinder structure holds the presoak temperature to close tolerances. To properly presoak, fill the drum container with tempered presoak water and allow it to set for one full minute before processing. In order to properly wash the developed film, both the cover assembly 8 and the plug assembly 25 are removed and the developed film left in the film container. The container is placed in the opposite vertical position used when pouring fluids into the film container 1. In this situation, however, running water is let pass in the end previously sealed by the plug assembly and flow out the end previous sealed by the cover assembly. To facilitate easy flow of the water out of the film container, the edge of the film drum has a plurality of indents 41, shown in FIG. 2. Of course, other means of allowing the water to freely flow out of the end of the film container could be used such as a small stand to lift the end of the container off the flat horizontal surface and naturally, the indents 41 could be at either end of the container structure.

An example of a step-by-step instruction is given in Table II for Unicolor K2, Kodak C41 processes, etc., for film types Kodacolor 2, Vericolor 2, types 5247, SO-245, SO-267, SO-276, etc. which are high temperature color negative processes. Here a presoak is required and the presoak temperature equals the developer temperature. However, equal temperatures of presoak and developer is not essential to this invention. It is possible in some cases to use different temperatures for presoak and developer in order to achieve the desired photographic result.

TABLE II

| STEP | USE THIS SOLUTION | AT THIS TEMPERATURE | FOR THIS TIME | WITH THIS TECHNIQUE |
|---|---|---|---|---|
| 1. | Water | 100±½° F (37.8±0.3° C) | 1 min. | Fill drum and allow to stand one (1) full minute. Drain completely. |
| 2. | Developer | 100±½° F (37.8±0.3° C) | 3¼ min. TIME CRITICAL for consistent resuts . . . | Pour in enough tempered developer to half-fill drum (see Table I). Place on UNICOLOR Uniroller, turn switch on and start time immediately. Remove film drum from Uniroller near end of step so as to include drain time in total for step. Make certain to drain completely. Note: Agitation can be done manually. |
| 3. | Blix | 100±5° F (37.8±3° C) | 6–7 min. Time not critical beyond minimum | Pour in enough tempered Blix to half-fill film drum. Place on Uniroller, turn switch on and start time. NOTE: Agitation can be done manually. |
| | The remaining steps can be done in normal roomlight with film drum lid off. | | | |
| 4. | (Running Water) | 100±5° F (37.8±3° C) | 3–4 min. Time not critical beyond minimum | |
| 5. | Stabilizer | 75–105° F (24–41° C) | 1–2 min. Time not critical beyond minimum. | Stabilizer can usually be prepared in tap water. However, a good practice is to use distilled or deionized water. |
| 6. | Dry | 75–105° F (24–41° C) | — | DO NOT SQUEEGEE FILM Hang in dust-free area. Remember to wash film drum parts thoroughly. |

It is to be understood that the present disclosure can be modified or varied by applying current knowledge without departing from the spirit and scope of the novel concepts of the invention.

I claim:

1. A variable volume film drum for processing photographic material including a container having two open ends for holding said material, a lockable piston adapted to be inserted in one end of said container and movable therein to any location and a fluid control assembly adapted to cover the remaining open end of said container for introducing fluids, the improvement comprising:

conduit means extending down the longitudinal axis of said container for providing an enclosed path for fluids to enter said container.

2. A variable volume film drum as set forth in claim 1 wherein said conduit means comprises:

at least one conduit reel with a central tube means having an outwardly extending tubular flange and the distal portion of said central means forming an aperture slightly larger in diameter than said flange.

3. A variable volume film drum as set forth in claim 2 wherein said assembly comprises an inwardly extending tubular segment for engaging an adjacent conduit reel.

4. A variable volume film drum as set forth in claim 3 wherein said piston comprises:

spacer means to displace an adjacent conduit reel above the surface of said piston.

5. A variable volume film drum as set forth in claim 1 wherein said conduit means comprises:

a plurality of conduit reels each reel with a central tube means having an outwardly extending tubular flange and the distal portion of said central means forming an aperture slightly larger in diameter than said flange whereby said flange of one reel engages the distal portion of an adjacent reel.

6. A variable volume film drum as set forth in claim 5 wherein said assembly comprises an inwardly extending tubular segment for engaging an adjacent conduit reel.

7. A variable volume film drum as set forth in claim 6 wherein said piston comprises:

spacer means to displace an adjacent conduit reel above the surface of said piston.

8. A variable volume film drum as set forth in claim 1 wherein said conduit means comprises:

a plurality of conduit reels each reel having a central tube means, a male engaging portion connected at one end of said central means and a female receiving portion connected at the opposite end of said central means whereby said male portion of one reel engages said female portion of an adjacent reel.

9. A photographic film receiving reel adapted for use in a system of identical adjacent reels, said reel comprising:

two annular disc shaped elements for holding said film;

a central hollow two ended axial member connecting the central portions of said disc shaped elements and having a longitudinal axis;

each of said disc shaped elements forming a plane by perpendicularly intersecting said longitudinal axis of said axial member; and, said axial member including, an outwardly extending flange formed at one end of said axial member and extending beyond said plane formed by one of said disc shaped elements, and a recessed receiving portion formed at the opposite end of said axial member and having a diameter slightly larger than the diameter of said flange to allow said recessed portion to receive the flange of an adjacent reel to form a conduit.

* * * * *